US008991192B2

(12) United States Patent
Wiebe et al.

(10) Patent No.: US 8,991,192 B2
(45) Date of Patent: Mar. 31, 2015

(54) FUEL NOZZLE ASSEMBLY FOR USE AS STRUCTURAL SUPPORT FOR A DUCT STRUCTURE IN A COMBUSTOR OF A GAS TURBINE ENGINE

(75) Inventors: David J. Wiebe, Orlando, FL (US); Timothy A. Fox, Hamilton (CA)

(73) Assignee: Siemens Energy, Inc., Orlando, FL (US)

( * ) Notice: Subject to any disclaimer, the term of this patent is extended or adjusted under 35 U.S.C. 154(b) by 1281 days.

(21) Appl. No.: 12/566,222

(22) Filed: Sep. 24, 2009

(65) Prior Publication Data

US 2011/0067402 A1 Mar. 24, 2011

(51) Int. Cl.

| | |
|---|---|
| ***F23R 3/28*** | (2006.01) |
| ***F23R 3/08*** | (2006.01) |
| ***F23R 3/34*** | (2006.01) |
| ***F23R 3/60*** | (2006.01) |
| ***F23R 3/54*** | (2006.01) |

(52) U.S. Cl.

CPC . *F23R 3/283* (2013.01); *F23R 3/08* (2013.01); *F23R 3/346* (2013.01); *F23R 3/54* (2013.01); *F23R 3/60* (2013.01)

USPC ..... 60/800; 60/799; 60/796; 60/733; 60/739

(58) Field of Classification Search

CPC ..... F23R 3/28; F23R 3/60; F23R 3/346; F23R 3/40; F23R 3/283; F23R 3/08; F23R 3/54

USPC ..... 60/733, 800, 752, 746, 747, 740, 799, 60/796, 753–760, 748, 739

See application file for complete search history.

(56) References Cited

U.S. PATENT DOCUMENTS

| | | | | |
|---|---|---|---|---|
| 3,934,409 | A * | 1/1976 | Quillevere et al. | 60/749 |
| 4,211,073 | A * | 7/1980 | Guillot | 60/746 |
| 4,718,238 | A * | 1/1988 | Todd et al. | 60/746 |
| 4,825,658 | A * | 5/1989 | Beebe | 60/748 |
| 4,845,952 | A * | 7/1989 | Beebe | 60/737 |
| 5,069,029 | A * | 12/1991 | Kuroda et al. | 60/776 |
| 5,121,597 | A * | 6/1992 | Urushidani et al. | 60/778 |
| 5,319,935 | A | 6/1994 | Toon et al. | |
| 5,327,718 | A * | 7/1994 | Iwata et al. | 60/773 |
| 5,826,429 | A | 10/1998 | Beebe et al. | |
| 5,894,720 | A * | 4/1999 | Willis et al. | 60/776 |
| 5,916,142 | A * | 6/1999 | Snyder et al. | 60/748 |
| 6,047,550 | A | 4/2000 | Beebe | |
| 6,192,688 | B1 | 2/2001 | Beebe | |

(Continued)

OTHER PUBLICATIONS

U.S. Appl. No. 12/233,903, filed Sep. 19, 2008, Fox et al.
U.S. Appl. No. 12/431,302, filed Apr. 28, 2009, Wiebe et al.
U.S. Appl. No. 12/180,657, filed Jul. 28, 2008, Ritland et al.
U.S. Appl. No. 12/477,397, filed Jun. 3, 2009, Fox et al.

*Primary Examiner* — William H Rodriguez
*Assistant Examiner* — Carlos A Rivera

(57) ABSTRACT

A fuel nozzle assembly for use in a combustor apparatus of a gas turbine engine. An outer housing of the fuel nozzle assembly includes an inner volume and provides a direct structural connection between a duct structure and a fuel manifold. The duct structure defines a flow passage for combustion gases flowing within the combustor apparatus. The fuel manifold defines a fuel supply channel therein in fluid communication with a source of fuel. A fuel injector of the fuel nozzle assembly is provided in the inner volume of the outer housing and defines a fuel passage therein. The fuel passage is in fluid communication with the fuel supply channel of the fuel manifold for distributing the fuel from the fuel supply channel into the flow passage of the duct structure.

17 Claims, 4 Drawing Sheets

(56) References Cited

U.S. PATENT DOCUMENTS

| | | | | |
|---|---|---|---|---|
| 6,487,860 | B2 | 12/2002 | Mayersky et al. | |
| 6,868,676 | B1 | 3/2005 | Haynes | |
| 8,281,594 | B2 * | 10/2012 | Wiebe | 60/733 |
| 2005/0034458 | A1 | 2/2005 | Burrus et al. | |
| 2005/0050902 | A1 | 3/2005 | Anichini et al. | |
| 2006/0101801 | A1 | 5/2006 | Bland | |
| 2007/0012043 | A1 | 1/2007 | Parker et al. | |
| 2009/0071159 | A1 * | 3/2009 | Parker et al. | 60/747 |

* cited by examiner

FUEL NOZZLE ASSEMBLY FOR USE AS STRUCTURAL SUPPORT FOR A DUCT STRUCTURE IN A COMBUSTOR OF A GAS TURBINE ENGINE

This invention was made with U.S. Government support under Contract Number DE-FC26-05NT42644 awarded by the U.S. Department of Energy. The U.S. Government has certain rights to this invention.

FIELD OF THE INVENTION

The present invention relates to a fuel nozzle assembly for use in a combustor apparatus of a gas turbine engine and, more particularly, to a fuel nozzle assembly that provides a direct structural connection between a duct structure and a fuel manifold.

BACKGROUND OF THE INVENTION

A conventional combustible gas turbine engine includes a compressor section, a combustion section including a plurality of combustor apparatuses, and a turbine section. Ambient air is compressed in the compressor section and directed to the combustor apparatuses in the combustion section. The pressurized air is mixed with fuel and ignited in the combustor apparatuses to create combustion products that define working gases. The working gases are routed to the turbine section via a plurality of transition ducts. Within the turbine section are rows of stationary vanes and rotating blades. The rotating blades are coupled to a shaft and disc assembly. As the working gases expand through the turbine section, the working gases cause the blades, and therefore the shaft, to rotate.

It is known that injecting fuel at two axially spaced apart fuel injection locations, i.e., via an upstream fuel injection system associated with a main combustion zone and a downstream fuel injection system downstream from the main combustion zone, reduces the production of NOx by a combustor apparatus. For example, if a significant portion of fuel is injected at a location downstream of the main combustion zone, i.e., by the downstream fuel injection system, the amount of time that second combustion products, created by the fuel injected by the downstream fuel injection system, are at a high temperature is reduced as compared to first combustion products, created by the fuel injected into the main combustion zone by the upstream fuel injection system. Since NOx production is increased by the elapsed time that combustion products are at a high combustion temperature, combusting a portion of the fuel downstream of the main combustion zone reduces the time the second combustion products are at a high temperature, such that the amount of NOx produced by the combustor apparatus is reduced.

SUMMARY OF THE INVENTION

In accordance with a first embodiment of the present invention, a fuel nozzle assembly is provided in combination with a duct structure in a combustor apparatus of a gas turbine engine comprising. The duct structure comprises an intermediate duct structure between a liner duct structure and a transition duct and defines a flow passage for combustion gases flowing from the liner duct structure to the transition duct. The intermediate duct structure is free to move axially with respect to each of the liner duct structure and the transition duct. The fuel nozzle assembly comprises an outer housing and a fuel injector. The outer housing is coupled to the intermediate duct structure and to a fuel manifold that defines a fuel supply channel therein in fluid communication with a source of fuel. The outer housing includes an inner volume and structurally supports the intermediate duct structure between the liner duct structure and the transition duct. The fuel injector is provided in the inner volume of the outer housing and defines a fuel passage therethrough. The fuel passage is in fluid communication with the fuel supply channel of the fuel manifold for distributing the fuel from the fuel supply channel into the flow passage of the intermediate duct structure.

In accordance with a second embodiment of the invention, a combustor apparatus is provided in a gas turbine engine. The combustor apparatus comprises a combustor device coupled to a main engine casing, a liner duct structure, an intermediate duct structure, and a fuel injection system. The combustor device comprises a flow sleeve for receiving pressurized air and a liner duct structure disposed radially inwardly from the flow sleeve. The liner duct structure has an inlet, an outlet, and an inner volume. The transition duct has an inlet section and an outlet section. The intermediate duct structure is disposed between the liner duct structure and the transition duct and defines a flow passage for combustion gases flowing from the liner duct structure to the transition duct. The intermediate duct structure has inlet and outlet portions, wherein the intermediate duct structure inlet portion is associated with the liner duct structure outlet such that movement may occur between the intermediate duct structure and the liner duct structure, and the intermediate duct structure outlet portion is associated with the transition duct inlet section such that movement may occur between the intermediate duct structure and the transition duct. The fuel injection system is associated with the intermediate duct structure and comprises a fuel manifold and a plurality of fuel nozzle assemblies. The fuel manifold is coupled to structure within the engine to provide structural support for the fuel injection system and for the intermediate duct structure. The fuel manifold defines a fuel supply channel therein that is in fluid communication with a source of fuel. The fuel nozzle assemblies each comprise an outer housing and a fuel injector. The outer housing of each fuel nozzle assembly defines an inner volume and spans between and is coupled to both of the fuel manifold and the intermediate duct structure to provide structural support for the intermediate duct structure via the fuel manifold. The fuel injector of each fuel nozzle assembly is provided in the inner volume of each respective outer housing. Each fuel injector defines a fuel passage therethrough that is in fluid communication with the fuel supply channel of the fuel manifold for distributing the fuel from the fuel supply channel into the flow passage of the intermediate duct structure.

In accordance with a third embodiment of the invention, a fuel nozzle assembly is provided for use in a combustor apparatus of a gas turbine engine. An outer housing of the fuel nozzle assembly includes an inner volume and provides a direct structural connection between a duct structure and a fuel manifold. The duct structure defines a flow passage for combustion gases flowing within the combustor apparatus. The fuel manifold defines a fuel supply channel therein in fluid communication with a source of fuel. A fuel injector of the fuel nozzle assembly is provided in the inner volume of the outer housing and defines a fuel passage therein. The fuel passage is in fluid communication with the fuel supply channel of the fuel manifold for distributing the fuel from the fuel supply channel into the flow passage of the duct structure.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
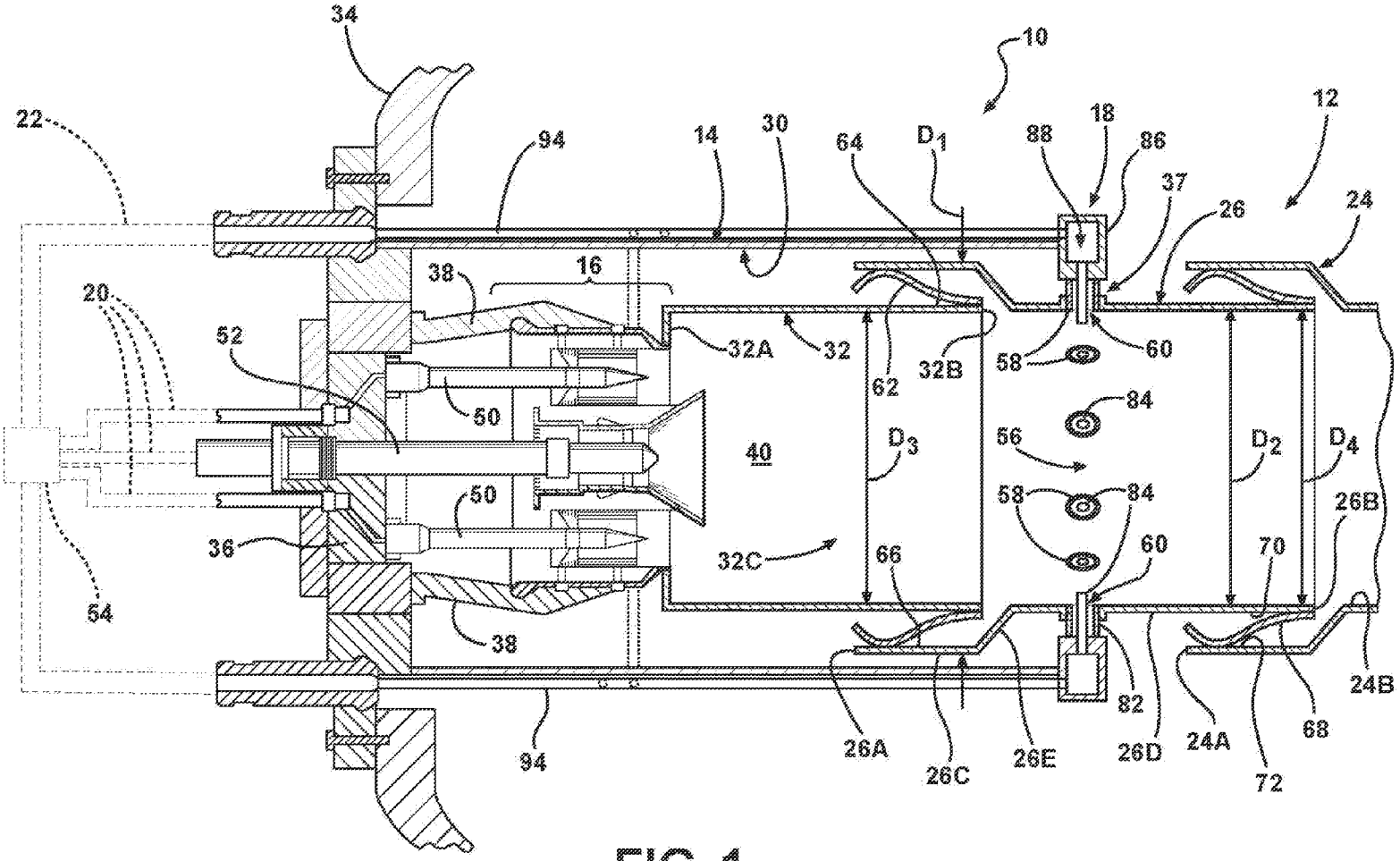
FIG. 1 is a side cross sectional view of a combustor apparatus including a plurality of fuel nozzle assemblies according to an embodiment of the invention.

Referring to FIG. 1, a combustor apparatus 10 forming part of a can-annular combustion system 12 in a gas turbine engine is shown. The engine further comprises a compressor section (not shown) and a turbine section (not shown). Air enters the compressor section where the air is pressurized. The pressurized air is then delivered to a plurality of the combustor apparatuses 10 of the combustion system 12. In each of the combustor apparatuses 10, the pressurized air from the compressor section is mixed with a fuel at two locations in the illustrated combustor apparatus 10, i.e., an upstream location and a downstream location, which will both be discussed in detail herein, to create upstream and downstream air and fuel mixtures. The air and fuel mixtures are ignited to create hot combustion products that define working gases. The working gases are routed from the combustor apparatuses 10 to the turbine section. The working gases expand in the turbine section and cause blades coupled to a shaft and disc assembly to rotate.

As noted above, the can-annular combustion system 12 comprises a plurality of the combustor apparatuses 10. Each combustor apparatus 10 comprises a combustor device 14, a first fuel injection system 16, a second fuel injection system 18, a first fuel supply structure 20, a second fuel supply structure 22, a transition duct 24, and, in the embodiment shown, an intermediate duct structure 26. The combustor apparatuses 10 are spaced circumferentially apart from one another within the combustion system 12.

Only a single combustor apparatus 10 is illustrated in FIG. 1. Each combustor apparatus 10 forming a part of the can-annular combustion system 12 can be constructed in the same manner as the combustor apparatus 10 illustrated in FIG. 1. Hence, only the combustor apparatus 10 illustrated in FIG. 1 will be discussed in detail herein.

As shown in FIG. 1, the combustor device 14 of the combustor apparatus 10 comprises a flow sleeve 30 and a liner duct structure 32 disposed radially inwardly from the flow sleeve 30. The flow sleeve 30 is coupled to a main engine casing 34 of the engine via a cover plate 36 and receives pressurized air from the compressor section through an annular gap 37 formed between the flow sleeve 30 and the second fuel injection system 18. The flow sleeve 30 may be formed from any material capable of operation in the high temperature and high pressure environment of the combustion system 12, such as, for example, stainless steel, and in a preferred embodiment may comprise a steel alloy including chromium.

The liner duct structure 32 is coupled to the cover plate 36 via support members 38. As shown in FIG. 1, the liner duct structure 32 comprises an inlet 32A, an outlet 32B and has an inner volume 32C, which inner volume 32C at least partially defines a main combustion zone 40. The liner duct structure 32 may be formed from a high-temperature material, such as HASTELLOY-X (HASTELLOY is a registered trademark of Haynes International, Inc.).

The first fuel injection system 16 may comprise one or more main fuel injectors 50 coupled to and extending axially away from the cover plate 36, and a pilot fuel injector 52 also coupled to and extending axially away from the cover plate 36. The first fuel injection system 16 may also be referred to as a "main," a "primary" or an "upstream" fuel injection system. The first fuel supply structure 20 is in fluid communication with a source of fuel 54 and delivers fuel from the source of fuel 54 to the main and pilot fuel injectors 50 and 52. As noted above, the flow sleeve 30 receives pressurized air from the compressor through the gap 37. After entering the flow sleeve 30, the pressurized air moves into the liner duct structure inner volume 32C where fuel from the main and pilot fuel injectors 50 and 52 is mixed with at least a portion of the pressurized air in the inner volume 32C and ignited in the main combustion zone 40 to create combustion products defining first working gases.

The transition duct 24 may comprise a conduit having a generally cylindrical inlet section 24A, a main body section 24B, and a generally rectangular outlet section (not shown). The conduit may be formed from a high-temperature capable material, such as HASTELLOY-X, INCONEL 617, or HAYNES 230 (INCONEL is a registered trademark of Special Metals Corporation, and HAYNES is a registered trademark of Haynes International, Inc.). The transition duct outlet section includes structure that is coupled to a row 1 vane segment (not shown) of the turbine.

The intermediate duct structure 26 in the illustrated embodiment is located between the liner duct structure 32 and the transition duct 24 so as to define a flow passage 56 for the first working gases from the liner duct structure 32 to the transition duct 24.

Figure 2:
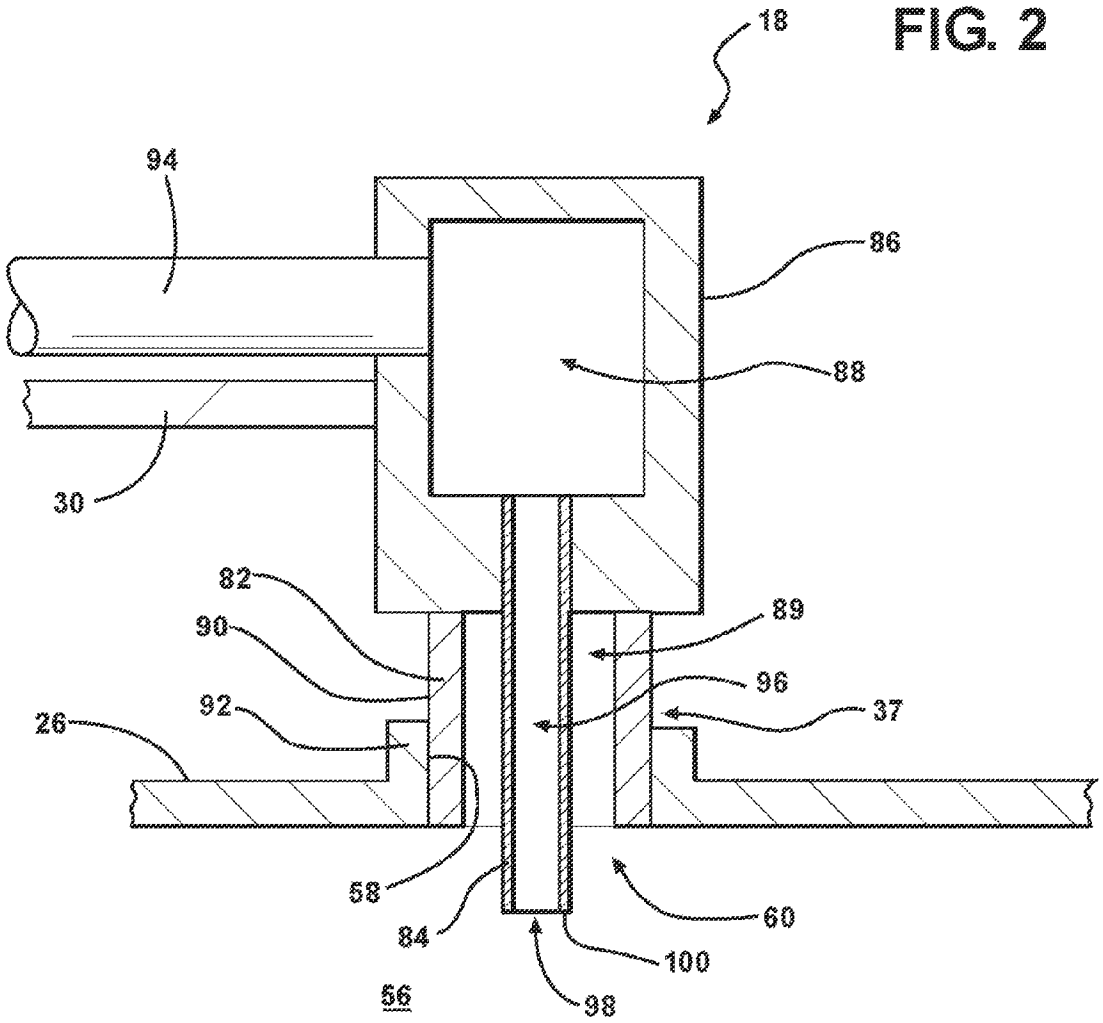
FIG. 2 is an enlarged cross sectional view illustrating one of the fuel nozzle assemblies shown in FIG. 1.

A plurality of secondary fuel injection openings 58 are formed in the intermediate duct structure 26, see FIGS. 1 and 2. The secondary fuel injection openings 58 are each adapted to receive a corresponding downstream fuel nozzle assembly 60 of the second fuel injection system 18. The second fuel injection system 18 may also be referred to as a "downstream" or a "secondary" fuel injection system. Additional details in connection with the second fuel injection system 18 will be described in greater detail below.

The intermediate duct structure 26 in the embodiment illustrated in FIG. 1 comprises a generally cylindrical inlet portion 26A, a generally cylindrical outlet portion 26B, and generally cylindrical first and second mid-portions 26C and 26D, respectively, and an angled portion 26E joining the first and second mid-portions 26C and 26D to one another. The first generally cylindrical mid-portion 26C is proximate to the inlet portion 26A and the second generally cylindrical mid-portion 26D is proximate to the outlet portion 26B. In the embodiment shown, the angled portion 26E is located upstream from the secondary fuel injection openings 58 and defines a transition between differing inner diameters of the first and second mid-portions 26C and 26D. Specifically, the angled portion 26E transitions between a first, larger inner diameter $D_1$ of the first generally cylindrical mid-portion 26C and a second, smaller inner diameter $D_2$ of the second generally cylindrical mid-portion 26D. The inlet portion 26A has the same inner diameter $D_1$ as the first generally cylindrical mid-portion 26C, while the outlet portion 26B has the same inner diameter $D_2$ as the second generally cylindrical mid-portion 26D. It is understood that the intermediate duct structure 26 may have a substantially constant diameter along its entire extent if desired, or the diameter $D_2$ of the second mid-portion 26D could be greater than the diameter $D_1$ of the first mid-portion 26C.

The inlet portion 26A of the intermediate duct structure 26 is positioned over the liner duct structure outlet 32B, see FIG. 1. An outer diameter $D_3$ of the liner duct structure outlet 32B in the embodiment shown is smaller than the inner diameter $D_1$ of the intermediate duct inlet portion 26A but is generally equivalent to the inner diameter $D_2$ of the intermediate duct mid-portion 26D and to a diameter $D_4$ of the intermediate duct outlet portion 26B, i.e., the liner duct structure outlet 32B is generally coaxial with the intermediate duct mid-portion 26D and the intermediate duct outlet portion 26B, as clearly shown in FIG. 1. A contoured first spring clip structure 62 (also known as a finger seal) is provided on an outer surface 64 of the liner duct structure outlet 32B and frictionally engages an inner surface 66 of the intermediate duct inlet portion 26A such that a friction fit coupling is provided between the liner duct structure 32 and the intermediate duct structure 26. The friction fit coupling allows movement, i.e., axial, circumferential, and/or radial movement, between the liner duct structure 32 and the intermediate duct structure 26, which movement may be caused by thermal expansion of one or both of the liner duct structure 32 and the intermediate duct structure 26 during operation of the engine. Alternatively, it is contemplated that the first spring clip structure 62 may be coupled to the inner surface 66 of the intermediate duct inlet portion 26A so as to frictionally engage the outer surface 64 of the liner duct structure outlet 32B.

In an alternative embodiment, the liner duct structure 32 and the intermediate duct structure 26 are generally coaxial and the first spring clip structure 62 is eliminated. In such an embodiment, an inner diameter of the intermediate duct inlet portion 26A may be slightly larger than the outer diameter of the liner duct structure outlet 32B. Hence, the intermediate duct structure 26 may be coupled to the liner duct structure 32 via a slight friction fit or a piston-ring type arrangement. The intermediate duct angled portion 26E may also be eliminated, such that the intermediate duct structure 26 may comprise a substantially uniform inner diameter along generally its entire extent.

The inlet section 24A of the transition duct 24 is fitted over the intermediate duct outlet portion 26B, see FIG. 1. An outer diameter of the intermediate duct outlet portion 26B in the embodiment shown is smaller than an inner diameter of the transition duct inlet section 24A. A second contoured spring clip structure 68 is provided on an outer surface 70 of the intermediate duct outlet portion 26B and frictionally engages an inner surface 72 of the transition duct inlet section 24A such that a friction fit coupling is provided between the intermediate duct structure 26 and the transition duct 24. The friction fit coupling allows movement, i.e., axial, circumferential, and/or radial movement, between the intermediate duct structure 26 and the transition duct 24, which movement may be caused by thermal expansion of one or both of the intermediate duct structure 26 and the transition duct 24 during operation of the engine. Alternatively, it is contemplated that the second spring clip structure 68 may be coupled to the inner surface 72 of the transition duct inlet section 24A so as to frictionally engage the outer surface 70 of the intermediate duct outlet portion 26B.

Because the intermediate duct structure 26 is provided between the liner duct structure 32 and the transition duct 24, and the first and second spring clip structures 62 and 68 frictionally couple the liner duct structure 32 to the intermediate duct structure 26 and the intermediate duct structure 26 to the transition duct 24, two joints are defined along the axial path that the working gases take as they move into the transition duct 24. That is, a first joint is defined where the intermediate duct structure 26 engages the liner duct structure 32 and a second joint is defined where the intermediate duct structure 26 engages the transition duct 24. These two joints accommodate axial, radial and/or circumferential shifting of the liner duct structure 32 and the transition duct 24 with respect to the intermediate duct structure 26 due to non-uniformity in temperatures in the liner duct structure 32, the transition duct 24, the intermediate duct structure 26 and structure mounting the liner duct structure 32 and the transition duct 24 within the engine casing.

As more clearly shown in FIG. 2, each fuel nozzle assembly 60 of the second fuel injection system 18 extends through a corresponding one of the secondary fuel injection openings 58 formed in the intermediate duct structure 26 so as to communicate with and inject fuel into the flow passage 56 defined by the intermediate duct structure 26, which flow passage 56 is defined at a location downstream from the main combustion zone 40 (see FIG. 1).

Each fuel nozzle assembly 60 comprises an outer housing 82 and a fuel injector 84. The outer housing 82 of each fuel nozzle assembly 60 spans between the intermediate duct structure 26 and a fuel manifold 86 of the second fuel injection system 18 to provide a direct structural connection between the intermediate duct structure 26 and the fuel manifold 86. The fuel manifold 86 defines a fuel supply channel 88 therein for delivering fuel to the fuel injector 84, as will be described in detail herein. In the embodiment shown, the outer housing 82 comprises a generally cylindrical and rigid member and includes an inner volume 89 in which the fuel injector 84 is provided.

The outer housing 82 is coupled to the intermediate duct structure 26 and structurally supports the intermediate duct structure 26 between the liner duct structure 32 and the transition duct 24 via the fuel manifold 86, as will be described herein. The coupling comprises an engagement of an outer surface 90 of the outer housing 82 with structure 92 of the intermediate duct structure 26 that defines the corresponding secondary fuel injection opening 58. The outer housing 82 is slidably received in its corresponding secondary fuel injection opening 58 such that the outer housing 82 and the intermediate duct structure 26 can move radially independently of each other, which radial movement may occur during operation of the engine as will be discussed further herein. However, the engagement between the outer surface 90 of the outer housing 82 with the structure 92 of the intermediate duct structure 26 permits the intermediate duct structure 26 and the outer housing 82, and, thus, the fuel nozzle assembly 60, to move axially and circumferentially together.

The outer housing 82 is also coupled to the fuel manifold 86, such as, for example, by welding, such that the outer housing 82 is rigidly attached to and structurally supported by the fuel manifold 86. As the fuel manifold 86 in the embodiment shown is structurally affixed to the flow sleeve 30, which is in turn structurally affixed to the engine casing 34, the fuel manifold 86 provides structural support for the fuel nozzle assembly 60, and, thus for the intermediate duct structure 26, via the affixation of the fuel manifold 86 to the flow sleeve 30. It is noted that the fuel manifold 86 may be structurally supported by other structure within the combustor apparatus 10, as will be described herein with reference to FIGS. 3 and 4.

The fuel nozzle assembly 60 according to this embodiment is not structurally affixed to the liner duct structure 32 or the transition duct 24, but, rather, is structurally affixed to the intermediate duct structure 26. Since the intermediate duct structure 26 can move independently from both the liner duct structure 32 and the transition duct 24, as discussed above, the fuel nozzle assembly 60, and also the fuel manifold 86, which is structurally affixed to the fuel nozzle assembly 60, can also move independently from the liner duct structure 32 and the transition duct 24. Thus, relative movement between the intermediate duct structure/fuel nozzle assembly/fuel manifold and the liner duct structure 32 will not result in stress imparted on these structures, which might otherwise result if the fuel nozzle assembly/fuel manifold were directly affixed to the liner duct structure 32. Similarly, relative movement between the intermediate duct structure/fuel nozzle assembly/fuel manifold and the transition duct 24 will not result in stress imparted on these structures, which might otherwise result if the fuel nozzle assembly/fuel manifold were directly affixed to the transition duct 24.

It is noted that any relative radial movement between the fuel nozzle assemblies 60 and the intermediate duct structure 26 may be accommodated by the slidable engagement of the outer housings 82 of the fuel nozzle assemblies 60 within the secondary fuel injection openings 58 in the intermediate duct structure 26. However, any axial or circumferential movement of the intermediate duct structure 26, the fuel nozzle assemblies 60, the fuel manifold 86, or the flow sleeve 30 will result in all of these structures moving axially or circumferentially together.

As noted above, the fuel manifold 86 delivers fuel to the fuel injector 84 via the fuel supply channel 88 defined by the fuel manifold 86. The fuel manifold 86, which may comprise an annular manifold, extends completely or at least partially around a circumference of the intermediate duct structure 26. The fuel supply channel 88 of the fuel manifold 86 receives fuel from the source of fuel 54 via the second fuel supply structure 22, which, in the embodiment shown, comprises a pair of fuel supply tubes 94, but may comprise additional or fewer fuel supply tubes 94. Optionally, the fuel supply tubes 94 may comprise a series of bends defining circumferential direction shifts to accommodate relative movement between each fuel supply tube 94 and the fuel manifold 86, such as may result from thermally induced movement of one or both of the fuel supply tubes 94 and the fuel manifold 86. Additional description of a fuel supply tube having circumferential direction shifts may be found in U.S. patent application Ser. No. 12/233,903, filed on Sep. 19, 2008, entitled "COMBUSTOR APPARATUS IN A GAS TURBINE ENGINE," the entire disclosure of which is incorporated herein by reference.

The fuel injector 84 defines a fuel passage 96 therein in fluid communication with the fuel supply channel 88 of the fuel manifold 86, which fuel passage 96 receives fuel from the fuel supply channel 88. The fuel passage 96 is in fluid communication with a fuel injection port 98 defined at distal end 100 of the fuel injector 84, which fuel injection port 98 distributes the fuel into the flow passage 56 defined by the intermediate duct structure 26. It is noted that the fuel injector 84 in the embodiment shown in FIGS. 1 and 2 extends radially past the outer housing 82 and into the flow passage 56 defined by the intermediate duct structure 26, while the outer housing 82 extends only up to the intermediate duct structure 26.

The fuel injected by the fuel injectors 84 into the flow passage 56 defined by the intermediate duct structure 26 mixes with at least a portion of the remaining pressurized air, i.e., pressurized air not ignited in the main combustion zone 40 with the fuel supplied by the first injection system 16, and ignites with the remaining pressurized air to define further combustion products defining second working gases.

It is noted that injecting fuel at two axially spaced apart fuel injection locations, i.e., via the first fuel injection system 16 and the second fuel injection system 18, may reduce the production of NOx by the combustor apparatus 10. For example, since a significant portion of the fuel, e.g., about 15-30% of the total fuel supplied by the first fuel injection system 16 and the second fuel injection system 18, is injected at a location downstream of the main combustion zone 40, i.e., by the second fuel injection system 18, the amount of time that the second combustion products are at a high temperature is reduced as compared to first combustion products resulting from the ignition of fuel injected by the first fuel injection system 16. Since NOx production is increased by the elapsed time the combustion products are at a high combustion temperature, combusting a portion of the fuel downstream of the main combustion zone 40 reduces the time the combustion products resulting from the second portion of fuel provided by the second fuel injection system 18 are at a high temperature, such that the amount of NOx produced by the combustor apparatus 10 may be reduced.

The fuel nozzle assemblies 60 may be substantially equally spaced in the circumferential direction, or may be configured in other patterns as desired, such as, for example, a random pattern. Further, the number, size, and location of the fuel nozzle assemblies 60 and corresponding openings 58 formed in the intermediate duct structure 26 may vary depending on the particular configuration of the combustor apparatus 10 and the amount of fuel to be injected by the second fuel injection system 18. However, in a preferred embodiment, the number of fuel nozzle assemblies 60 employed in a given combustor apparatus 10 is at least 3, and in a most preferred embodiment is at least 8.

Figure 3:
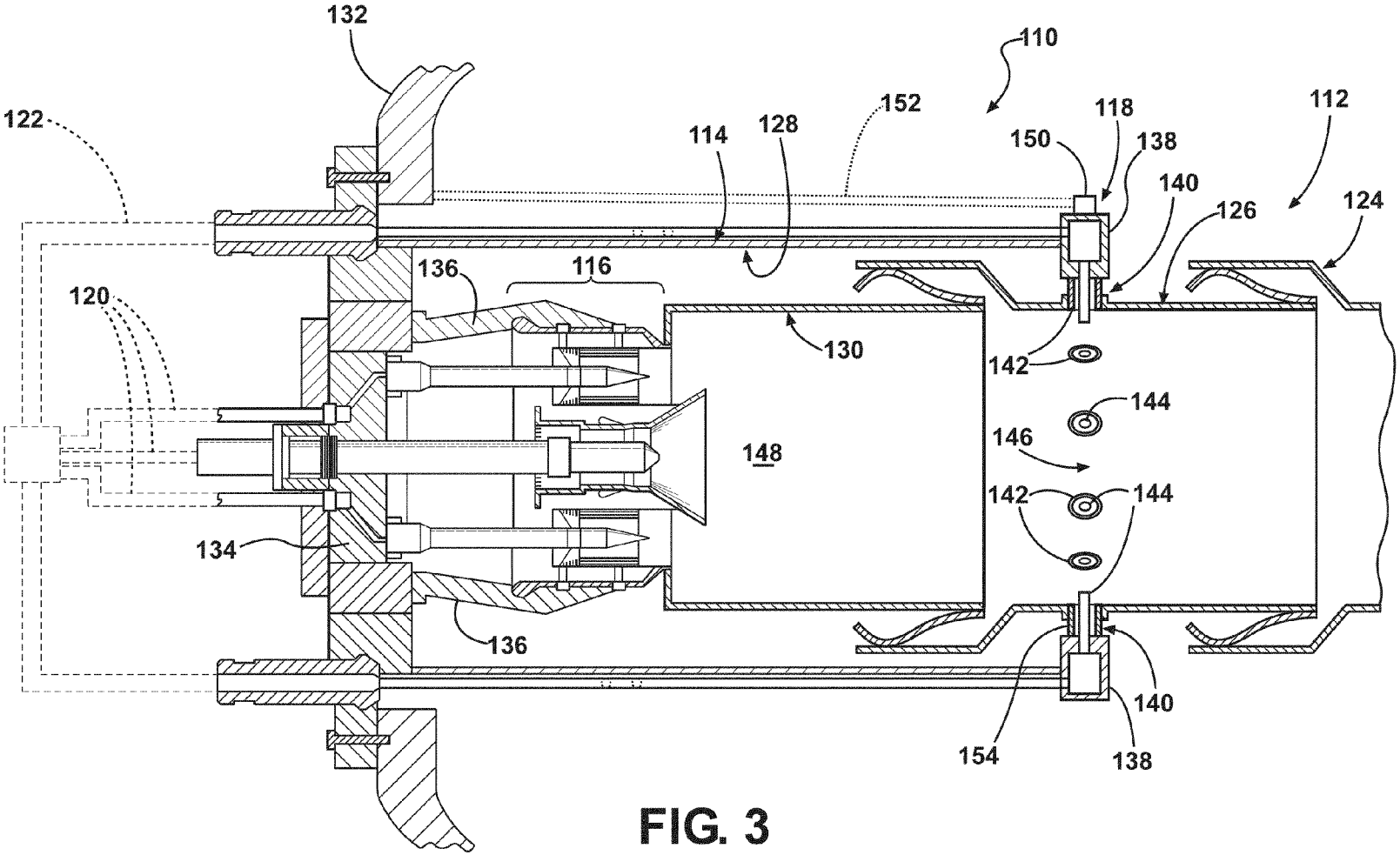
FIG. 3 is a side cross sectional view of a combustor apparatus including a plurality of fuel nozzle assemblies according to another embodiment of the invention.

Referring to FIG. 3, a combustor apparatus 110 constructed in accordance with a second embodiment of the present invention and adapted for use in a can-annular combustion system 112 of a gas turbine engine is shown. The combustor apparatus 110 includes a combustor device 114, a first fuel injection system 116, a second fuel injection system 118, a first fuel supply structure 120, a second fuel supply structure 122, a transition duct 124, and an intermediate duct 126.

The combustor device 114 comprises a flow sleeve 128 and a liner duct structure 130 disposed radially inwardly from the flow sleeve 128. The flow sleeve 128 is coupled to a main engine casing 132 via a cover plate 134. The liner duct structure 130 is coupled to the cover plate 134 via support members 136.

The second fuel injection system 118 includes a fuel manifold 138 and a plurality of fuel nozzle assemblies 140 that extend through corresponding openings 142 in the intermediate duct structure 126. The fuel nozzle assemblies 140 comprise fuel injectors 144 that inject fuel into a flow passage 146 defined by the intermediate duct structure 126 at a location downstream from a main combustion zone 148 defined by the liner duct structure 130.

The fuel manifold 138 according to this embodiment is not directly affixed to the flow sleeve 128 as in the embodiment described above for FIGS. 1-2. Rather, the fuel manifold 138 in this embodiment is structurally affixed to a mounting structure 150 that is coupled to other structure within the combustor apparatus 110. In the embodiment shown in FIG. 3, the fuel manifold 138 is diagrammatically illustrated as being structurally affixed to the main engine casing 132 via the mounting structure 150 and a structural member 152. The structural member 152 is shown in dashed lines in FIG. 3 to represent a possible structural attachment between the fuel manifold 138 and the main engine casing 132. However, the structural member 152 may structurally attach the fuel manifold 138 to other structures within/proximate to the combustor apparatus 110, and may take on any suitable shape, size, configuration, etc. Other suitable structures to which the structural member 152 may be attached to structurally support the fuel manifold 138 include the flow sleeve 128, the cover plate 134, or other structure within the combustor apparatus 110 capable of structurally supporting the fuel manifold 138, the fuel nozzle assemblies 140, and the intermediate duct structure 126, which, as described above with reference to FIGS. 1-2, is structurally affixed in axial and circumferential directions to outer housings 154 of the fuel nozzle assemblies 140, but is capable of moving radially with respect to the outer housings 154 as a result of the outer housings 154 being slidably received in their corresponding openings 142 in the intermediate duct structure 126. It is noted that the structural member 152 can preferably accommodate some amount of relative movement between the fuel manifold 138 and the other structure to which the structural member 152 is attached, such as may result from thermal expansion of the intermediate duct structure 126, the fuel nozzle assemblies 140, the fuel manifold 138, and/or the other structure to which the structural member 152 is attached.

Remaining structure of the combustor apparatus 110 according to this embodiment is substantially the same as that described above with reference to FIGS. 1-2. However, since the fuel manifold 138, the fuel nozzle assemblies 140, and the intermediate duct structure 126 according to this embodiment are not structurally tied to the flow sleeve 128, the flow sleeve 128 is free to move independently of the fuel manifold 138, the fuel nozzle assemblies 140, and the intermediate duct structure 126, and vice versa.

Figure 4:
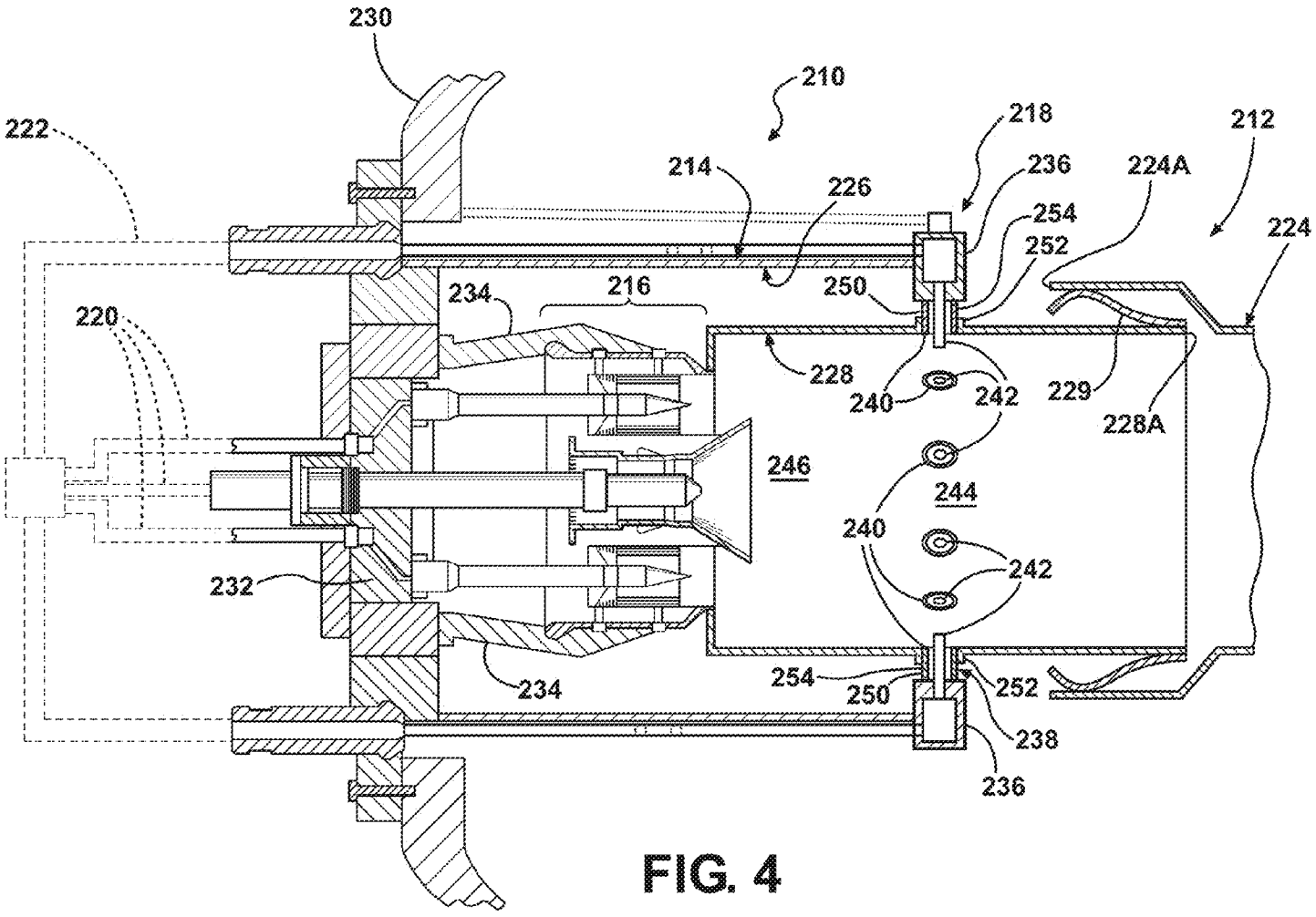
FIG. 4 is a side cross sectional view of a combustor apparatus including a plurality of fuel nozzle assemblies according to yet another embodiment of the invention.

Referring to FIG. 4, a combustor apparatus 210 constructed in accordance with a third embodiment of the present invention and adapted for use in a can-annular combustion system 212 of a gas turbine engine is shown. The combustor apparatus 210 includes a combustor device 214, a first fuel injection system 216, a second fuel injection system 218, a first fuel supply structure 220, a second fuel supply structure 222, and a transition duct 224.

The combustor device 214 comprises a flow sleeve 226 and a liner duct structure 228 disposed radially inwardly from the flow sleeve 226. The flow sleeve 226 is coupled to a main engine casing 230 via a cover plate 232. The liner duct structure 228 is coupled to the cover plate 232 via support members 234. It is noted that, in this embodiment, since there is no intermediate duct structure, i.e., the intermediate duct structures 26 and 126 as described above with reference to FIGS. 1-2 and 3, a contoured spring clip structure 229 is provided in a radial gap between a liner duct structure outlet 228A and a transition duct inlet 224A, such that a friction fit coupling is provided between the liner duct structure 228 and the transition duct 224. The friction fit coupling allows movement, i.e., axial, circumferential, and/or radial movement, between liner duct structure 228 and the transition duct 224, which movement may be caused by thermal expansion of one or both of the liner duct structure 228 and the transition duct 224 during operation of the engine.

The second fuel injection system 218 includes a fuel manifold 236 and a plurality of fuel nozzle assemblies 238, which, in this embodiment, extend through corresponding openings 240 formed in the liner duct structure 228. The fuel nozzle assemblies 238 comprise fuel injectors 242 that inject fuel into a flow passage 244 defined by the liner duct structure 228. The flow passage 244 is located downstream from a main combustion zone 246 defined by the liner duct structure 228.

The fuel manifold 236 according to this embodiment is not directly affixed to the flow sleeve 226 as in the embodiment described above for FIGS. 1-2. Rather, the fuel manifold 236 in this embodiment is structurally affixed to the liner duct structure 228 via outer housings 250 of the fuel nozzle assemblies 238. Specifically, as illustrated in FIG. 4, the outer housings 250 of the fuel nozzle assemblies 238 comprise rigid members that provide a direct structural connection between the liner duct structure 228 and the fuel manifold 236. Thus, the fuel manifold 236 and its associated fuel nozzle assemblies 238 are structurally supported within the combustor apparatus 210 via the liner duct structure 228, which, as noted above, is coupled to the cover plate 232 via the support members 234.

The outer housings 250 of the fuel nozzle assemblies 238 are slidably received in the openings 240 of the liner duct structure 228 such that relative radial movement may occur between the fuel nozzle assemblies 238 and the liner duct structure 228. Further, structure 252 of the liner duct structure 228 that defines the openings 240 that receive the fuel nozzle assemblies 252 engage outer surfaces 254 of the outer housings 250 such that the liner duct structure 228 and the outer housings 250, and, thus, the fuel manifold 236, can move axially and circumferentially together.

Remaining structure of the combustor apparatus 210 according to this embodiment is substantially the same as that described above with reference to FIGS. 1-2. However, since the fuel manifold 236 and the fuel nozzle assemblies 238 according to this embodiment are structurally tied to the liner duct structure 228 and not to the flow sleeve 226, the flow sleeve 226 is free to move independently of the fuel manifold 236, the fuel nozzle assemblies 238, and the liner duct structure 228, and vice versa.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fuel nozzle assembly in combination with a duct structure in a combustor apparatus of a gas turbine engine comprising:

a duct structure comprising:

an intermediate duct structure between a liner duct structure and a transition duct and defining a flow passage for combustion gases flowing from said liner duct structure to said transition duct, said intermediate duct structure being free to move axially with respect to each of said liner duct structure and said transition duct, wherein said intermediate duct structure includes a portion that has a generally constant intermediate duct diameter and said liner duct structure has a generally constant liner duct diameter generally equivalent to said intermediate duct diameter, and wherein said intermediate and liner duct structures are aligned with one another such that said intermediate and liner duct structures are generally coaxial;

a fuel injection system associated with said intermediate duct structure, said fuel injection system comprising:

an annular fuel manifold defining a fuel supply channel therein, said fuel supply channel in fluid communication with a source of fuel; and a plurality of fuel nozzle assemblies, each fuel nozzle assembly comprising:

an outer housing coupled to said intermediate duct structure and to said fuel manifold, wherein said fuel manifold is structurally affixed to a flow sleeve, which is structurally affixed to a main engine casing, and said fuel manifold providing structural support for the fuel nozzle assembly and for said intermediate duct structure via the affixation of said fuel manifold to said flow sleeve, said outer housing structurally supporting said intermediate duct structure between said liner duct structure and said transition duct, said outer housing comprising an inner volume; and a fuel injector provided in said inner volume of said outer housing, said fuel injector defining a fuel passage therethrough, said fuel passage in fluid communication with said fuel supply channel of said fuel manifold for distributing fuel from said fuel supply channel into said flow passage of said intermediate duct structure, wherein said fuel injector extends radially inwardly from said annular manifold and passes through a corresponding opening in said intermediate duct structure.

2. The fuel nozzle assembly of claim 1, wherein said outer housing of each said fuel nozzle assembly comprises a generally cylindrical and rigid member.

3. The fuel nozzle assembly of claim 1, wherein said outer housing of each said fuel nozzle assembly is slidably received in said corresponding opening formed in said intermediate duct structure such that said outer housing of each said fuel nozzle assembly and said intermediate duct structure are movable radially independently from each other.

4. The fuel nozzle assembly of claim 3, wherein structure of said intermediate duct structure that defines each said opening engages an outer surface of said corresponding outer housing such that said intermediate duct structure and each said outer housing are movable axially and circumferentially together.

5. The fuel nozzle assembly of claim 1, wherein said outer housing of each said fuel nozzle assembly extends up to said intermediate duct structure at said corresponding opening and said fuel injector of each said fuel nozzle assembly extends radially past said corresponding outer housing and into said flow passage defined by said intermediate duct structure.

6. The fuel nozzle assembly of claim 1, wherein a distal end of said fuel injector of each said fuel nozzle assembly defines a fuel injection port in fluid communication with said fuel passage, and each said fuel injection port delivers fuel into said flow passage defined by said intermediate duct structure.

7. A combustor apparatus in a gas turbine engine comprising:

a combustor device coupled to a main engine casing, said combustor device comprising:

a flow sleeve for receiving pressurized air; and a liner duct structure disposed radially inwardly from said flow sleeve, said liner duct structure having an inlet, an outlet, and an inner volume, wherein said liner duct structure has a generally constant liner duct diameter;

a transition duct having an inlet section and an outlet section;

an intermediate duct structure disposed between said liner duct structure and said transition duct and defining a flow passage for combustion gases flowing from said liner duct structure to said transition duct, said intermediate duct structure having inlet and outlet portions, wherein said intermediate duct structure inlet portion is associated with said liner duct structure outlet such that movement is possible between said intermediate duct structure and said liner duct structure, and said intermediate duct structure outlet portion is associated with said transition duct inlet section such that movement is possible between said intermediate duct structure and said transition duct, wherein said intermediate duct structure has a portion having a constant intermediate duct diameter, said intermediate duct and liner duct diameters are generally equivalent to each other, and said intermediate and liner duct structures are aligned such that said intermediate and liner duct structures are generally coaxial; and a fuel injection system associated with said intermediate duct structure, said fuel injection system comprising:

an annular fuel manifold structurally affixed to one of said flow sleeve, which is affixed to said main engine casing, and a mounting device coupled to said main engine casing, to provide structural support for said fuel injection system via the affixation of said fuel manifold to said one of said flow sleeve and said mounting device, said fuel manifold defining a fuel supply channel therein, said fuel supply channel in fluid communication with a source of fuel;

a plurality of fuel nozzle assemblies, each fuel nozzle assembly comprising:

an outer housing defining an inner volume and spanning between and coupled to both of said fuel manifold and said intermediate duct structure to provide structural support for said intermediate duct structure via said fuel manifold; and a fuel injector in said inner volume of said outer housing, said fuel injector defining a fuel passage therethrough, said fuel passage in fluid communication with said fuel supply channel of said fuel manifold for distributing fuel from said fuel supply channel into said flow passage of said intermediate duct structure, wherein said fuel injector extends radially inwardly from said annular manifold and passes through a corresponding opening in said intermediate duct structure.

8. The combustor apparatus of claim 7, wherein said inner volume of said liner duct structure defines a main combustion zone, and said flow passage defined by said intermediate duct structure is located downstream from said main combustion zone.

9. The combustor apparatus of claim 7, wherein said outer housing of each said fuel injector assembly is slidably received in the corresponding opening formed in said intermediate duct structure such that said outer housing of each said fuel injector assembly and said intermediate duct structure are movable radially independently from each other.

10. The combustor apparatus of claim 9, wherein structure of said intermediate duct structure that defines at least one of said openings that receives a corresponding outer housing engages an outer surface of said outer housing such that said intermediate duct structure and said outer housing are movable axially and circumferentially together.

11. A fuel injection system for use in a combustor apparatus during operation of a gas turbine engine comprising:

a plurality of fuel nozzle assemblies each comprising:

an outer housing defining an inner volume and attached to an annular fuel manifold that is structurally supported by an engine casing, said annular fuel manifold providing structural support for said fuel nozzle assemblies and for an intermediate duct structure via the support of said annular fuel manifold by the engine casing, said intermediate duct structure located between a liner duct structure and a transition duct and defining a flow passage for combustion gasses flowing from said liner duct structure to said transition duct, wherein said outer housing extends radially inwardly from said annular fuel manifold and is slidably received in a corresponding opening formed in said intermediate duct structure such that said outer housing and said intermediate duct structure are movable radially independently from each other, said intermediate duct structure being free to move axially with respect to each of said liner duct structure and said transition duct, wherein said annular fuel manifold defines a fuel supply channel therein in fluid communication with a source of fuel, and wherein said outer housing structurally supports said intermediate duct structure between said liner duct structure and said transition duct via said annular fuel manifold; and a fuel injector provided in said inner volume of said outer housing, said fuel injector defining a fuel passage therein, said fuel passage in fluid communication with said fuel supply channel of said annular fuel manifold for distributing fuel from said fuel supply channel into said flow passage of said intermediate duct structure.

12. The fuel injection system of claim 11, wherein structure of said intermediate duct structure that defines each said opening that receives each said outer housing engages an outer surface of each said outer housing such that said intermediate duct structure and each said outer housing are movable axially and circumferentially together.

13. The fuel injection system of claim 11, wherein said intermediate duct structure includes an outlet portion having a diameter that is generally equivalent to a diameter of an outlet of the liner duct structure.

14. The fuel injection system of claim 11, wherein each said outer housing is rigidly attached to and structurally supported by said annular fuel manifold.

15. The fuel injection system of claim 14, wherein said annular fuel manifold extends circumferentially about said intermediate duct structure.

16. The fuel injection system of claim 15, wherein said at least one outer housing comprises an annular array of outer housings.

17. The fuel injection system of claim 11, wherein said annular fuel manifold is structurally affixed to a flow sleeve, which is structurally affixed to the engine casing.

* * * * *